United States Patent [19]

Guilbaud

[11] 3,965,859

[45] June 29, 1976

[54] APPARATUS FOR TREATMENT OF TOWS FOR FIBERS BY IMMERSION IN A LIQUID

[75] Inventor: Jean-Pierre Guilbaud, Mably, France

[73] Assignee: Ateliers Roannais de Constructions Textiles, Roanne, France

[22] Filed: Mar. 7, 1975

[21] Appl. No.: 556,390

[30] Foreign Application Priority Data

Mar. 8, 1974 France ..... 74.08097

[52] U.S. Cl. ..... 118/428

[51] Int. Cl.[2] ..... B05C 3/12

[58] Field of Search..... 118/420, 428, DIG. 19; 19/65 T, 66 T, 66 R; 68/200, 202

[56] References Cited

UNITED STATES PATENTS

| | | | |
|---|---|---|---|
| 1,734,737 | 11/1929 | Martindell | 118/DIG. 19 |
| 1,736,566 | 11/1929 | York | 118/420 X |
| 2,459,254 | 1/1949 | Van Der Mei | 118/420 X |
| 2,527,465 | 10/1950 | Toulmin, Jr. | 118/420 X |

*Primary Examiner*—Dorsey Newton

*Attorney, Agent, or Firm*—Stevens, Davis, Miller & Mosher

[57] ABSTRACT

System for treatment of a tow of fibers which are to be at least partially immersed in a liquid treatment bath, including hold-down bar and tow-guide combinations situated in at least two parallel vertical planes. The tow-guides are inclined with respect to the vertical and to each other. The means for attaching the hold-down bars and tow-guides allows positioning thereof in different positions.

5 Claims, 6 Drawing Figures

FIG. 5
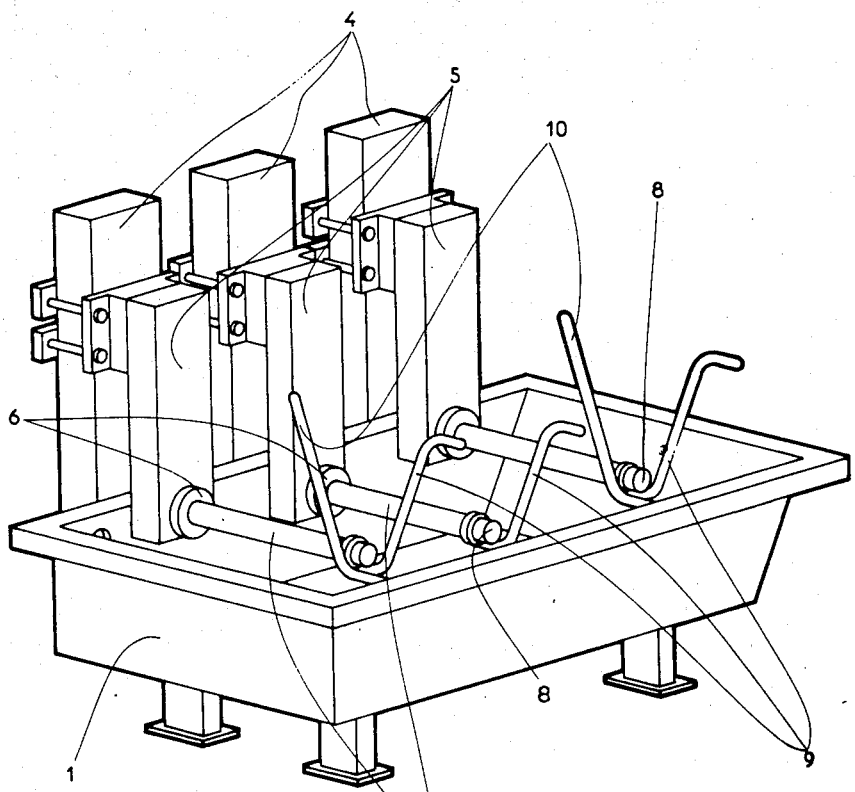
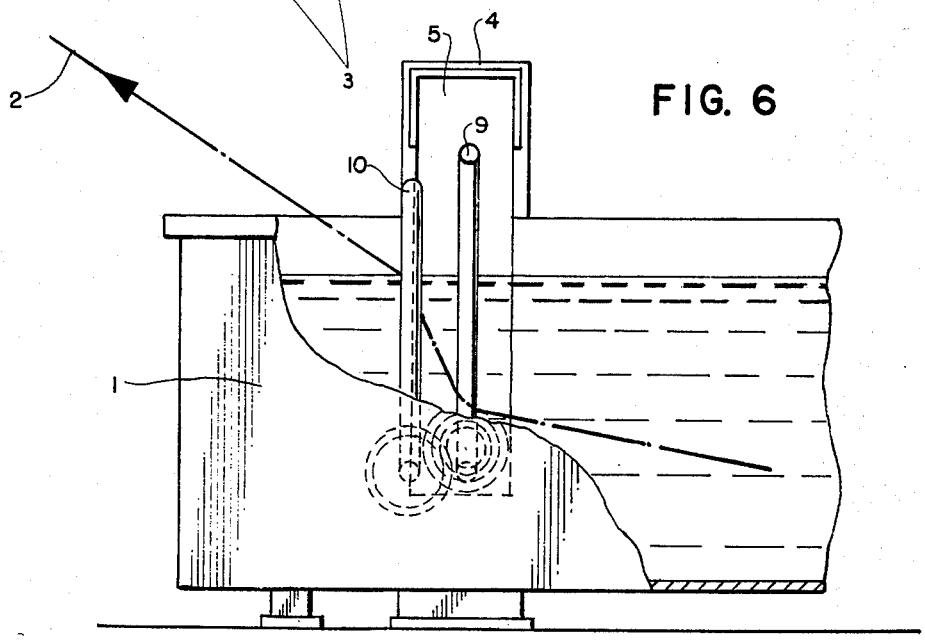
FIG. 6

APPARATUS FOR TREATMENT OF TOWS FOR FIBERS BY IMMERSION IN A LIQUID

The present invention relates to a new device for the treatment of tows for fibers by immersion in a liquid.

"Tow for fibers" or "tow," in this context means a collection of a large number of filaments which are twist-free and are not interlaced to any marked extent, and which are to be converted to fibers by cutting or splitting.

In the manufacture of chemical (artificial or synthetic) fibers, it is well known to treat the tows for fibers by immersing them in liquid baths. This treatment can form part of the manufacturing process (as in the case of regenerated cellulose fibers) or can also be a sizing treatment (as in the case of some synthetic fibers).

To do this, the tow is generally immersed in the treatment bath by passing it under a suitable number of pulleys or cylindrical hold-down bars which are partially or completely immersed and which may be fixed or rotating. This leads to considerable difficulties when it is desired to pass this tow under these pulleys or hold-down bars manually, especially when the treatment bath is hot, corrosive or toxic.

In order to facilitate this immersion process and to make it unnecessary for the operator to have to put his hands in the bath, it has been proposed to mount the cylindrical hold-down bars on a spiked frame which is held above the tank when the tow is passing horizontally and which is then lowered in order to immerse the tow into the bath. This solution, which is itself satisfactory although it necessarily places the tow under excess tension when it is being lowered into the bath, is expensive to realize.

The present invention overcomes these disadvantages. It relates to a device of the type in question which is simple and easy to manipulate, and which makes it unnecessary for the operator to put his hands in the tank in order to pass the cable under the hold-down bars.

This device for the treatment of a tow for fibers which is at least partially immersed in the liquid treatment bath contained in a tank and which passes under hold-down bars mounted, especially so as to overhang into the tank, especially on one of the vertical walls of the tank, is characterized in that, in the vicinity of one of the hold-down bars, the device also comprises a tow-guide combination situated in two parallel vertical planes:

The first tow-guide, which is inclined relative to the horizontal and is situated in the vertical plane passing through the axis of the hold-down bar, is fixed to the free end of the hold-down bar so that it is flush with the lower generatrix of the hold-down bar, and the second tow-guide, which is situated downstream from the first relative to the direction of forward movement of the tow, is fixed, at the same level as the first, to the vertical wall of the tank opposite the wall on which the hold-down bar is mounted so that it overhangs into the tank. After its point of attachment to the wall, the tow-guide comprises a horizontal part followed by a part which is inclined relative to the vertical and the slope of which is opposite to the slope of the first tow-guide.

If the treatment tank includes several hold-down bars, the device according to the invention is applied at least to the inlet and outlet hold-down bars of the tank.

In practice, the tow-guides consist of bars of suitable diameter, made of stainless steel or chrome steel.

It has been established that good results are obtained if the angle formed by the inclined parts of the two tow-guides is approximately 60°.

As has already been stated, the hold-down bars are mounted so that they overhang into the tank. They can be mounted on one of the vertical walls of the tank, or on a vertical support placed inside the tank, thus achieving an equivalent result.

Likewise, the free end of the first tow-guide fixed to the hold-down bar advantageously comprises a portion which is curved and passes over the rim of the tank.

The invention and the advantages which result therefrom will be more apparent from the exemplary embodiment which follows, and which is given by way of indication and without implying a limitation, and which relates to the attached figures.

FIG. 5 shows, in perspective, a treatment tank equipped according to the invention.

FIG. 6 is a side view of the device shown in FIG. 3.

Figure 1:
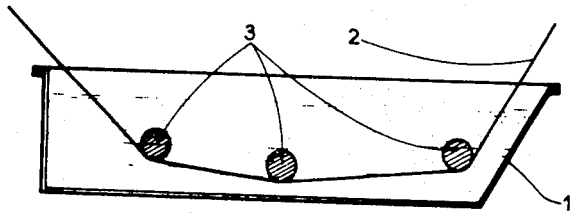
FIG. 1 shows, diagrammatically and in longitudinal cross-section, a tank for the treatment of a tow for fibers by means of baths.

Referring to FIG. 1, a tank 1 contains a treatment liquid which has not been given a reference number. A suitable number of hold-down bars 3 are mounted, so that they overhang into tank 1, and the tow for fibers 2 which has to be treated passes under these hold-down bars 3 which hold the tow down in the treatment bath.

In the vicinity of the inlet and/or outlet hold-down bar 3 (see FIGS. 2 and 3), there is a support post 4, out-side the tank 1, to which there is fixed, at its upper part, the vertical support 5 which is placed in the tank 1 and which holds the hold-down bar 3 at its base. At its lower part, this support 5 carries a device 6 for attaching the hold-down bar 3 which is horizontal and under which the tow 2 is fitted.

At the free end 7 of the hold-down bar 3, there is fixed, by means of a strap 8, a first tow-guide 9 made of stainless steel, which:

At its lower part, fits into and is flush with the lower generatrix of the hold-down bar 3, at its middle part, is inclined at approximately 30° to the vertical and slopes toward the vertical wall of the tank opposite that on which the hold-down bar is mounted so that it overhangs into the tank, and at its upper part, is curved so that it passes over the rim of the tank 1.

This tow-guide 9 is situated substantially in a vertical plane, which passes through the axis of the hold-down bar 3.

Downstream from this tow-guide 9, relative to the direction of forward movement of the tow in the tank, a second tow-guide 10, also comprising a bar made of stainless steel, is fixed at 11, that is at the same level as 9, to the wall of the tank opposite the support 5. This tow-guide 10, which is also in a plane which is vertical and parallel to the vertical plane of 9 (see FIG. 6), comprises a lower horizontal part, the generatrix of which is in the same lower horizontal plane as that of the guide 9, the said lower horizontal part being joined to an upper part which is also inclined at about 30° relative to the vertical.

The inclined portions of the two tow-guides 9 and 10 thus, on projection, form an angle of approximately 60° with one another. The value of this angle, as well as the actual shape and the nature of the guides 9 and 10, can be modified and adapted depending on the nature of the treatment baths and that of the tows to be treated.

As has already been stated, the hold-down bars 3 can be fixed or rotating. In the case of fixed hold-down bars, the tow always passes on substantially the same generatrix, and thus gives rise to the danger of damaging the surface of the hold-down bar and thus, in the long term, of fraying the tow.

Figure 4:
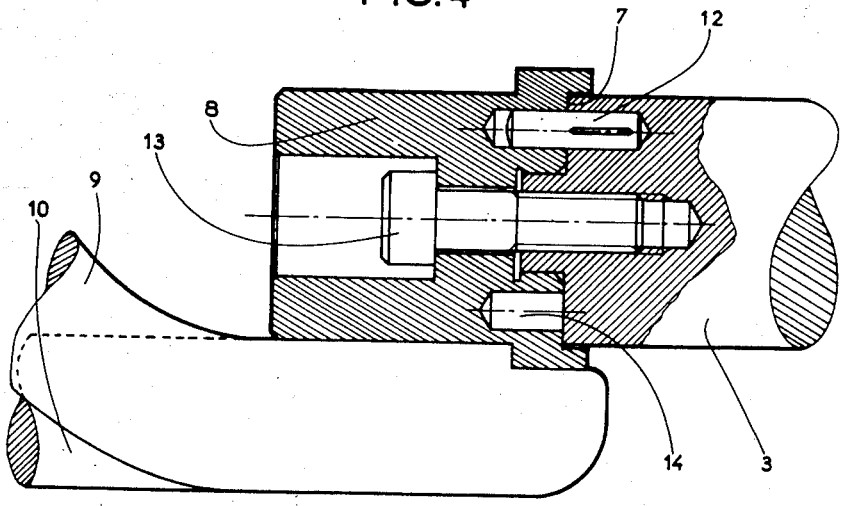
FIG. 4 shows a practical way of effecting the connection between the first tow-guide and the hold-down bar.

In order to overcome this disadvantage, the strap 6 for fixing the hold-down bar 3 to the support 5, where the bar is mounted so as to overhang into the tank, possesses attachment holes which make it possible to position the hold-down bar about its axis, for example six holes which make it possible to rotate the bar through 60° from time to time. In order to return the guide 9 to its normal vertical position (see FIG. 4), the strap 8 possesses an identical number of recessed holes 14, into one of which there is inserted a marking pin 12 fitted, by applying force to the face 7 of the hold-down bar 3.

The guide 9 and the hold-down bar 3 are joined together by means of a central screw 13.

Figure 2:
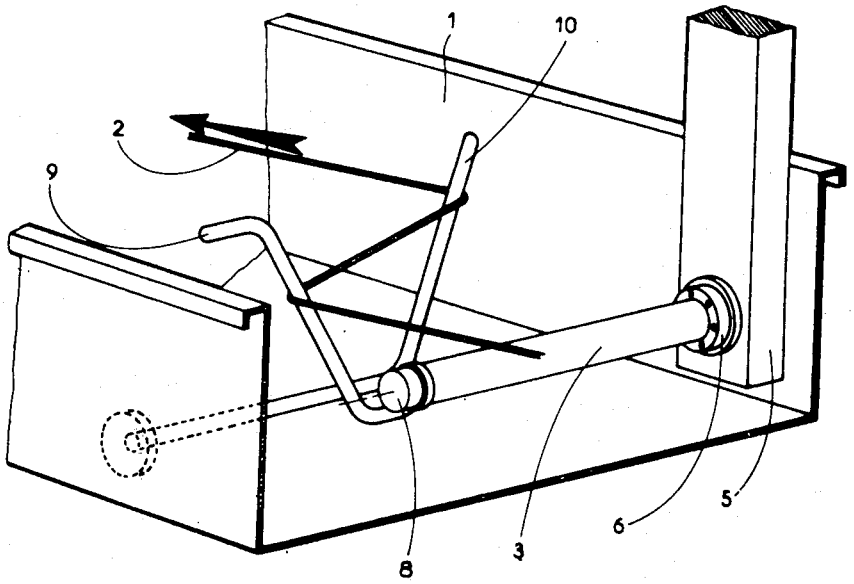
FIG. 2 represents, in perspective, a device according to the invention.
Figure 3:
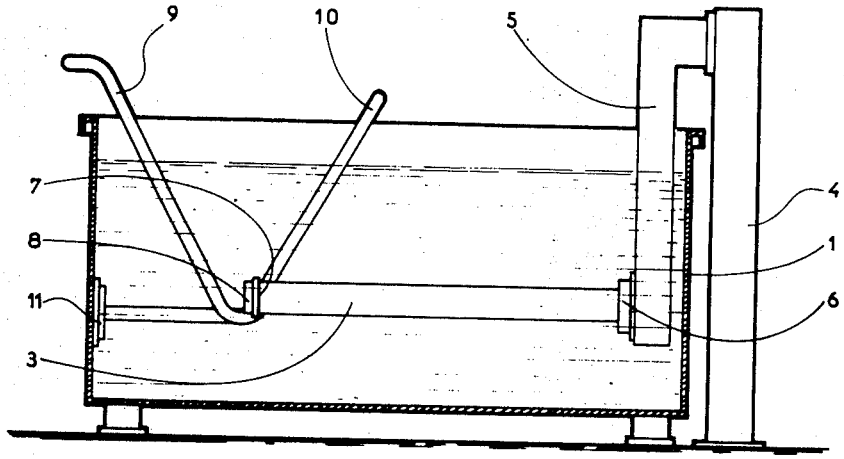
FIG. 3 is a diagrammatic representation of a device according to FIG. 2.

The device according to the invention operates in the following way (see FIG. 2). The operator grips the end of the tow 2, and first fits it under the curved part of the free end of the tow-guide 9 above the tank 1. He then passes it under the inclined part of the guide 10 which protrudes from the bath, and then he continues to move along the tank 1, pulling the tow 2. Because of the combined slants of the two guides 9 and 10, the tow 2, under the effect of the traction exerted by the operator and his longitudinal movement, presses on the two opposite and convergent generatrices of the guides 9 and 10 and thus slides downward along these inclined parts. Thereafter, the tow is brought onto the curved portion which connects the guide 9 to the lower generatrix of the hold-down bar 3, so that the tow automatically takes up a position under this hold-down bar 3.

This procedure is repeated in the case of each hold-down bar, since the working process is the same for each.

The device according to the invention is suitable for the treatment, by immersion in a liquid, of tows for fibers. It can advantageously be used for the treatment of tows made from artificial fibers, at any stage during the formation of these tows (desulphurizing, washing, bleaching, sizing, and the like), as well as for the treatment of synthetic fibers manufactured by a dry method (sizing) or wet method (washing, sizing and the like).

Compared with the devices known hitherto, the present invention is characterized essentially by the great simplicity with which it can be constructed and used, and by the excellent degree of safety for the operator who thus no longer has to put his hands in the treatment bath.

What is claimed is:

1. An apparatus for the treatment of a tow for fibers which is at least partially immersed in a liquid treatment bath, comprising a tank having substantially vertical walls for containing a liquid treatment bath and which includes hold-down bars mounted, so as to overhang into the tank and over one of the vertical walls of the tank, said hold-down bars each having a free end spaced from the other side wall, wherein in the vicinity of one of the hold-down bars, the apparatus also comprises a tow-guide combination situated in two parallel vertical planes, including:

a first tow-guide inclined relative to the horizontal, situated in a vertical plane passing through the axis of the hold-down bar and fixed to the free end of the hold-down bar so that it is flush with the lower generatrix of the hold-down bar, and a second tow-guide, situated downstream from the first tow-guide relative to the direction of forward movement of the tow, and fixed, at the same level as the first, to the vertical wall of the tank opposite the wall on which the hold-down bar is mounted so that it overhangs into the tank after its point of attachment to the wall, the second tow-guide comprising a horizontal part followed by a part which is inclined relative to the vertical and the slope of which is opposite to the incline of the first tow-guide, each tow guide having a free end spaced from one side wall.

2. The apparatus of claim 1, wherein the angle formed by the combined inclined parts of the two tow-guides is approximately 60°.

3. The apparatus of claim 1, wherein the hold-down bar is mounted on one of the vertical walls of the treatment tank, so that it overhangs into the tank.

4. The apparatus of claim 1, wherein the hold-down bar is mounted on a vertical support placed in the treatment tank, so that it overhangs into the tank.

5. The apparatus of claim 1, wherein the free end of the first tow-guide fixed to the hold-down bar is curbed and passes over the rim of the tank.

* * * * *